US005395050A

United States Patent [19]

Nowak et al.

[11] Patent Number: 5,395,050

[45] Date of Patent: Mar. 7, 1995

[54] DEVICE FOR INJECTING A FUEL-GAS MIXTURE

[75] Inventors: Detlef Nowak, Stuttgart; Guenther Bantleon, Leonberg, both of Germany

[73] Assignee: Robert Bosch GmbH, Stuttgart, Germany

[21] Appl. No.: 188,492

[22] Filed: Jan. 28, 1994

[30] Foreign Application Priority Data

Feb. 17, 1993 [DE] Germany ..... 43 04 804.8

[51] Int. Cl.[6] ..... F02M 67/06

[52] U.S. Cl. ..... 239/121; 239/417.3; 239/585.4

[58] Field of Search ..... 239/585.4, 5, 120, 121, 239/417.3, 129, 424, 424.5, 585.1

[56] References Cited

U.S. PATENT DOCUMENTS 3,053,321 9/1962 Villaresi ..... 239/424.5 X
3,782,630 1/1974 Boltz et al. ..... 239/585.5 X
5,193,743 3/1993 Romann et al. ..... 239/1
5,197,672 3/1993 Grytz et al. ..... 239/417.3 X
5,232,163 8/1993 Grytz ..... 239/585.1 X
5,263,648 11/1993 Vogt et al. ..... 239/585.4

FOREIGN PATENT DOCUMENTS

4121372A1 12/1992 Germany .

*Primary Examiner*—Andres Kashnikow
*Assistant Examiner*—Kevin P. Weldon
*Attorney, Agent, or Firm*—Kenyon & Kenyon

[57] ABSTRACT

A device for injecting a fuel-gas mixture includes a cost-effective gas-containing sleeve which is capable of being easily assembled and simply adjusted. The gas-containing sleeve abuts with its casing part, for example, only on four rounded-off edges of the square valve end, while the casing part surrounds the surfaces of the valve end with a radial clearance, so that gas interspaces are formed in between for supplying gas. The injection device is particularly suited for injecting a fuel-gas mixture into the intake manifold of a mixture-compressing internal combustion engine having externally supplied ignition.

18 Claims, 4 Drawing Sheets

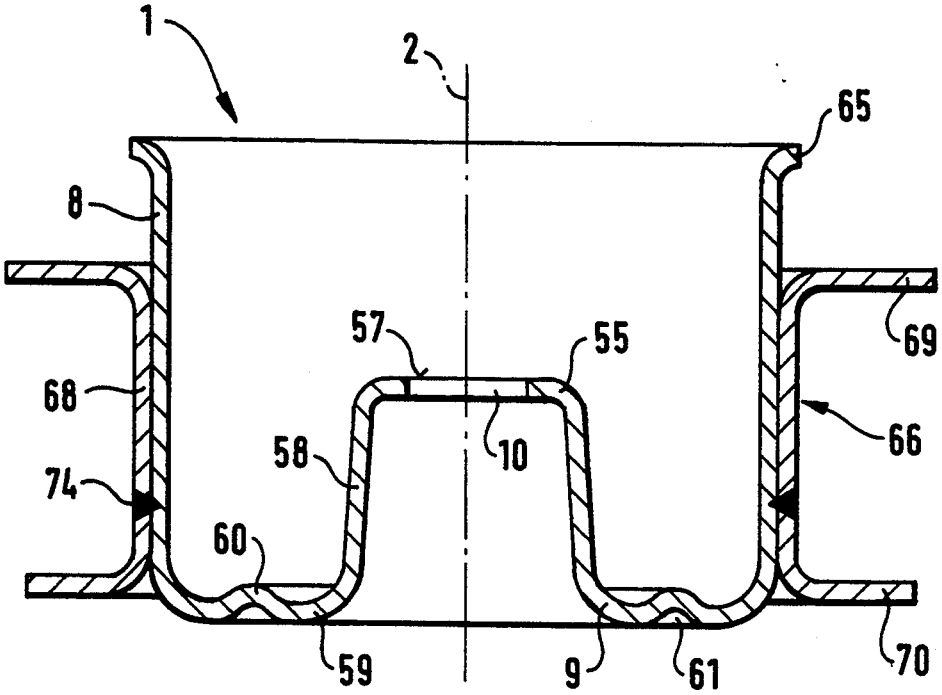
FIG. 2
FIG. 3
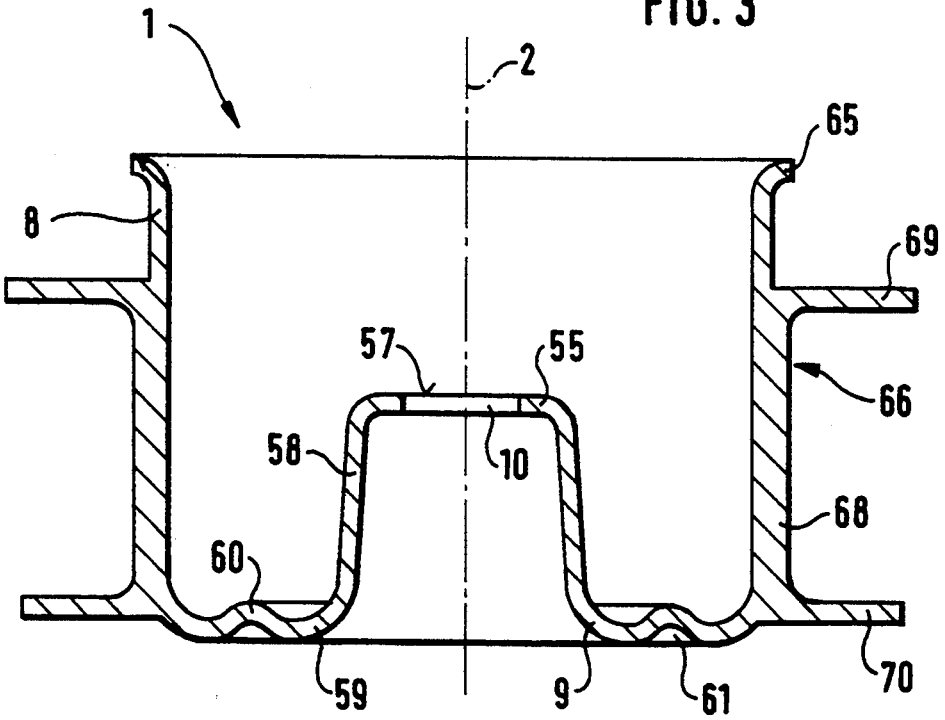

FIG. 6
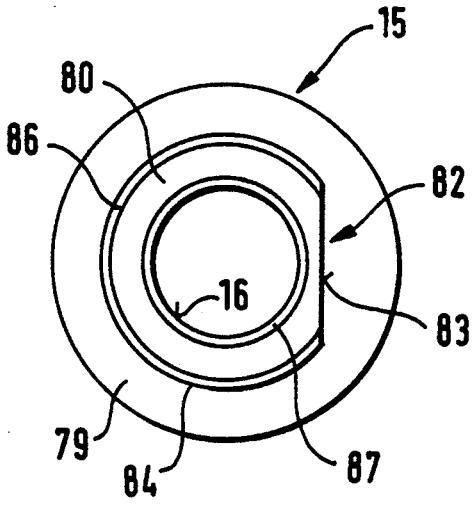
FIG. 7
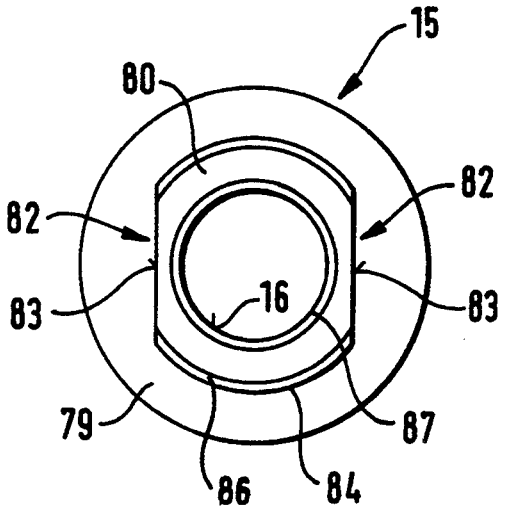
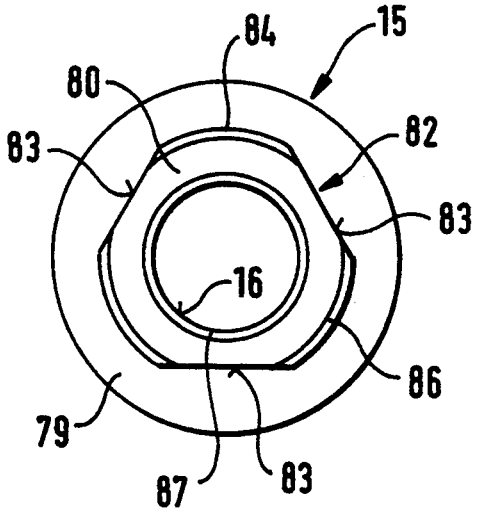
FIG. 8
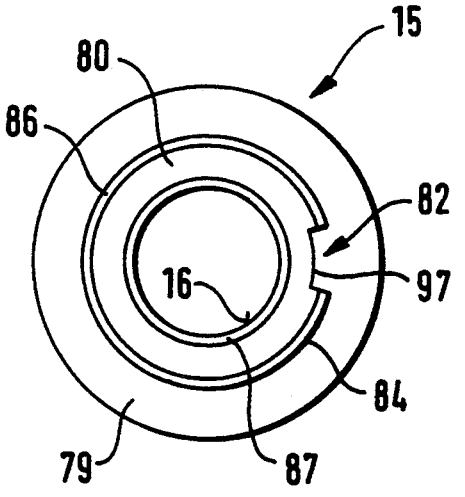
FIG. 9

DEVICE FOR INJECTING A FUEL-GAS MIXTURE

FIELD OF THE INVENTION

The present invention relates to a device for injecting a fuel-gas mixture.

BACKGROUND OF THE INVENTION

U.S. Pat. No. 5,193,743, corresponding to German Unexamined Patent Application No. DE 41 21 372, describes a device for injecting a fuel-gas mixture having a fuel-injection valve and a cup-shaped gas-containing (gas-enveloping) sleeve which axially surrounds, at least in part, the valve end of the fuel injection valve with its casing part and radially surrounds the valve end of the fuel injection valve, at least in part, with its base part. The design of the gas-containing sleeve is such that its base part has a concentric passage opening shaped diagonally to the valve end of the fuel-injection valve. In this manner, an annular gas gap is formed between an apertured spray disk situated at the downstream end of the fuel-injection valve and the base part of the gas-containing sleeve. This annular gas gap directly surrounds the passage opening.

Gas is supplied via ports in the casing part of the gas-containing sleeve, as well as via gas-flow-control channels. The axial dimensions of the annular gas gap are adjusted by axially sliding the gas-containing sleeve up to a stop face of the valve support. The actual value of the gas flow rate is subsequently measured, and the adjustment to the setpoint value is then made by removing material either from the stop face or from the base part of the gas-containing sleeve, or rather the base part is plastically deformed.

SUMMARY OF THE INVENTION

The device according to the present invention for injecting a fuel-gas mixture can be easily assembled and simply adjusted and represents a cost-effective solution for improving fuel preparation. The composite technique applied between the gas-containing sleeve and the valve support of the fuel-injection valve for directing the gas is particularly advantageous. The downstream end of the valve support has at least one depression situated opposite its circular periphery. This depression can be formed, for example, by removing material so that the circular casing part of the gas-containing sleeve abuts on only one or on several axially running, circular areas of the valve support.

As a result, gas interspaces are automatically created, for example, between the flat surfaces of the depressions of the valve support and the circular casing part of the gas-containing sleeve. These interspaces serve as gas-supply channels. The gas-containing sleeve secured to the axially running, circular areas of the valve support, for example, by means of laser-welding, is especially sturdy and is not able to slip after assembly, even when subjected to substantial shocks.

Further advantages of the present invention are obtained from a circumferential, upstream-projecting indentation introduced into an external radial area of the casing part of the gas-containing sleeve. A groove may be produced on the downstream side of the base part to improve the removal of precipitated fuel from the base part. The removal groove is used to collect fuel that has precipitated downstream from the base part of the gas-containing sleeve. It makes it possible for this fuel to be removed selectively and prevents fuel from travelling in the radial direction along the gas-containing sleeve to the outside. This prevents larger quantities of fuel from collecting on the radial areas of the gas-containing sleeve and from dripping off uncontrollably.

To facilitate the configuration of the welds joining the gas-containing sleeve to the fuel-injection valve, it is advantageous when a receiving and thrust ring arranged on the periphery of the casing part of the gas-containing sleeve does not cover an area on the periphery of the casing part of the gas-containing sleeve.

BRIEF DESCRIPTION OF THE DRAWINGS

FIG. 2 illustrates a gas-containing sleeve in accordance with a first exemplary embodiment.

FIG. 3 illustrates a gas-containing sleeve in accordance with a second exemplary embodiment.

FIG. 6 is a top view in the upstream direction of a valve support having one depression that is closed by a flat surface.

FIG. 7 is a top view in the upstream direction of a valve support having two depressions that are closed by flat surfaces.

FIG. 8 is a top view in the upstream direction of a valve support having three depressions that are closed by flat surfaces.

FIG. 9 is a top view in the upstream direction of a valve support having a grooved depression.

DETAILED DESCRIPTION

Figure 1:
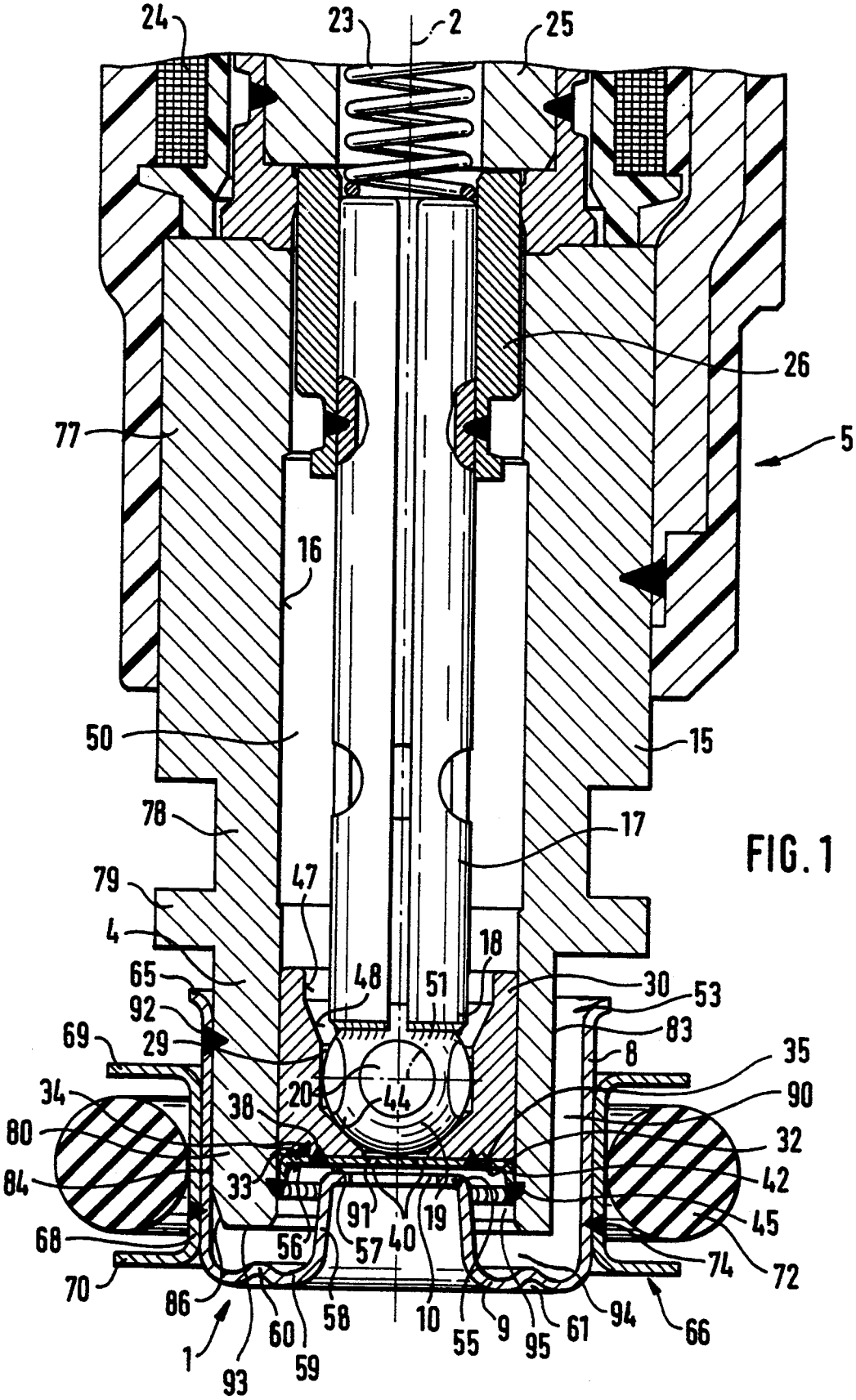
FIG. 1 is a partial view of a device for injecting a fuel-gas mixture in accordance with a first exemplary embodiment of the present invention.

A device for injecting a fuel-gas mixture is depicted illustratively in FIG. 1, based on the example of a mixture-compressing internal combustion engine having externally supplied ignition. This device includes a cup-shaped gas-containing sleeve 1, which comprises a valve end 4 of a fuel-injection valve 5 disposed concentrically to a longitudinal valve axis 2. With a casing part 8, the gas-containing sleeve 1 axially surrounds, at least in part, the valve end 4 of the fuel injection valve 5 and, with a base part 9, radially surrounds the valve end 4 of the fuel injection valve 5, at least in part. The base part 9 of the gas-containing sleeve 1 has a mixture-ejection-spray opening 10 running concentrically, for example, to the longitudinal valve axis 2.

The fuel-injection valve 5 has a tubular valve support 15, in which a longitudinal opening 16 is formed concentrically to the longitudinal valve axis 2. A tubular needle valve 17, for instance, is arranged in the longitudinal opening 16. This needle valve 17 is connected at its downstream end 18 facing the base part 9 of the gas-containing sleeve 1, for example, to a spherical valve-closing member 19, on whose periphery five flattenings 20 are provided.

The fuel-injection valve 5 is actuated electromagnetically, for example, in a generally known manner. A partially depicted electromagnetic circuit having a solenoid 24, a core 25 and an armature 26 is used to axially move the needle valve 17 to open a restoring spring 23 opposite a spring tension, or rather to close the fuel-injection valve 5. The armature 26 is connected by a weld, for example, to the end of the needle valve 17 facing away from the valve-closing member 19 and aligned to the core 25. The solenoid 24 surrounds the core 25, which represents the downstream end of an intake nipple for fuel that is not depicted in greater detail.

A guide opening 29 of a valve seat member 30 serves to guide the valve-closing member 19 during the axial movement of the needle valve 17 along the longitudinal valve axis 2. The periphery of the valve seat member 30 has a slightly smaller diameter than the diameter of the longitudinal opening 16 of the valve support 15. On the bottom front side 32 facing away from the valve-closing member 19, the valve seat member 30 is concentrically and securely affixed to a base 33, for example, of a cup-shaped apertured spray disk 34, so that the base 33 abuts with its top front side 35 on the bottom front side 32 of the valve seat member 30. A circumferential, impervious, first weld 38 on the base 33 joins the valve seat member 30 and the apertured spray disk 34. This type of assembly avoids the danger of unwanted deformation of the base 33 in the area of its at least one ejection-spray openings 40 formed through erosion or punching, four such openings depicted in the drawing.

Adjoining the cup-shaped apertured spray disk 34 is a circumferential retention rim 42, which extends in the direction of the longitudinal valve axis 2 so as to face away from the valve seat member 30, and is bent, downstream, conically to the outside. The diameter of the retention rim 42 at its downstream end is greater than the diameter of the longitudinal opening 16 in the valve seat member 15 in the area of the valve seat member 30. Since the circumferential diameter of the valve seat member 30 is smaller than the diameter of the longitudinal opening 16 of the valve support 15, a radial compression exists only between the longitudinal opening 16 and the retention rim 42 of the apertured spray disk 34. The retention rim 42 thereby exerts a radial spring action against the inner wall of the longitudinal opening 16.

At its downstream end, the retention rim 42 of the apertured spray disk 34 is connected to the inner wall of the longitudinal opening 16, for example, by means of a circumferential and impervious second weld 45. An impervious welding of the valve seat member 30 and the apertured spray disk 34, as well as of the apertured spray disk 34 and the valve support 15, is critical, so that the medium that is employed, for example a fuel, cannot flow through between the longitudinal opening 16 of the valve support 15 and the periphery of the valve seat member 30 to the ejection-spray openings 40 or between the longitudinal opening 16 of the valve support 15 and the retention rim 42 of the cup-shaped apertured spray disk 34, directly into an intake line of the internal combustion engine. Therefore, the two welds 38 and 45 constitute two fixing points on the cup-shaped apertured spray disk 34.

The spherical valve-closing member 19 interacts with a valve seat surface 44 of the valve seat member 30. This valve seat surface is tapered in a truncated-cone shape in the direction of flow and is formed in the axial direction between the guide opening 29 and the bottom front side 32 of the valve seat member 30. Facing the restoring spring 23, the valve seat member 30 has a valve-seat-member opening 47, whose diameter is greater than the diameter of the guide opening 29 of the valve seat member 30. A section 48 which adjoins the valve-seat-member opening 47 in the direction of the apertured spray disk 34 is distinguished by its truncated-cone-shaped tapering up to the diameter of the guide opening 29. The valve-seat-member opening 47 with its subsequent truncated-cone-shaped section 48 serves as a flow intake, so that the medium is able to flow from an interior valve space 50, which is delimited in the radial direction by the longitudinal opening 16 of the valve support 15, to the guide opening 29 of the valve seat member 30.

Five flattenings 20, for example, are introduced on the periphery of the spherical valve-closing member 19 to allow the flow of the medium to also reach the ejection-spray opening 40 of the apertured spray disk 34. The flattenings 20, which have a circular shape, for example, lie on the periphery of the spherical valve-closing member 19 with their center points in a horizontal plane 21, which is fixed more or less by the center point of the spherical valve-closing member 19 and which forms a right angle with the longitudinal valve axis 2. The five circular flattenings 20, whose center points are each spaced apart from one another by 72° on the periphery of the spherical valve-closing member 19, allow the medium to flow through in the open state of the injection valve from the interior valve space 50 up to the ejection-spray openings 40 of the apertured spray disk 34. To precisely guide the valve-closing member 19 and, thus, the needle valve 17 during the axial movement, the diameter of the guide opening 29 is conceived so as to allow the spherical valve-closing member 19 to project, outside of its flattening 20, through the guide opening 29 with a slight radial clearance.

The device according to the present invention is able to be mounted, for example, in a stepped valve mounting (not shown) of an intake manifold of the internal combustion engine or of a so-called fuel- and/or gas-distributor line. A gas-supply channel (likewise not shown), which is used to supply a gas to the gas-containing sleeve 1, is arranged so as to guarantee that the gas flows in directly at the upstream end 53 of the gas-containing sleeve 1. As gas, one can use, for example, the intake air that has been branched off through a bypass upstream from a throttle valve in the intake manifold of the internal combustion engine, air delivered through an additional blower, but also recirculated exhaust gas from the internal combustion engine, or a mixture of air and exhaust gas.

With its inner wall, the casing part 8 of the gas-containing sleeve 1 surrounds the periphery of the valve end 4, which likewise represents the downstream end of the valve support 15, while abutting both directly on at least one circular area and being secured to the valve support 15, as well as with radial clearance, to allow the gas to flow through, at least at one other recessed area of the valve support 15. The base part 9 of the gas-containing sleeve 1 has a step-type design.

Arranged concentrically to the longitudinal valve axis 2, the base part 9 has an inner radial area 55, which faces the apertured spray disk 34. The mixture-ejection-spray opening 10 is configured in the inner radial area 55 of the base part 9 of the gas-containing sleeve 1, concentrically to the longitudinal valve axis 2. The mixture-ejection-spray opening 10 in the inner radial area 55 has such a large diameter, that the fuel emerging upstream out of the ejection-spray openings 40 of the apertured spray disk 34 can emerge unimpeded through the mixture-ejection-spray opening 10 of the gas-containing sleeve 1.

Gas is supplied between a downstream side 56 of the base 33 of the apertured spray disk 34 and a top front side 57 of the inner radial area 55 of the base part 9 of the gas-containing sleeve 1 and, for purposes of an improved preparation, directly meets the sprayed-off fuel in a perpendicular direction. An axial area 58, which runs slightly conically and widens in a truncated-cone shape, adjoins the inner radial area 55 in the downstream direction. This axial area 58 gradually changes into an outer radial area 59, which runs radially to the outside in the direction of the casing part 8 and is axially removed in a downstream direction from the inner radial area 55 by exactly the measure of the axial extent of the axial area 58, and concentrically, for example, exhibits a circumferential, upstream-projecting indentation 60. The inner radial area 55, together with the mixture-ejection-spray opening 10, the axial area 58 and the outer radial area 59 thus form the base part 9 of the gas-containing sleeve 1.

The gas-containing sleeve 1 has a cup-shaped design, the downstream end of the gas-containing sleeve 1 being formed by the base part 9. In the final analysis, the base part 9 is likewise cup-shaped, the cup bottom being created in the upstream direction by the inner radial area 55, so that the inner cup of the base part 9 extends axially in a direction opposite that of the outer cup of the gas-containing sleeve 1.

FIGS. 2 and 3 clarify illustratively the refinement of the gas-containing sleeve. At the upstream end 53 of the gas-containing sleeve 1, the base part 8 has a collar 65 that points radially to the outside. The collar 65 on the base part 8 enables gas coming out of the gas-supply channel (not shown) situated upstream from the gas-containing sleeve 1 to flow more efficiently between the valve support 15 and the gas-containing sleeve 1. This is because the collar 65 produces an enlarged flow-in cross-section at the upstream end 53 of the gas-containing sleeve 1.

As is apparent in FIG. 2, a radially outwardly directed, circumferential, U-shaped receiving and thrust ring 66, having a cross-section that is open radially to the outside, is placed on the base part 8. The receiving and thrust ring 66 consists of an annular base 68 that is securely affixed to the casing part 8 of the gas-containing sleeve 1 and two radially running annular casing parts 69 and 70. The annular base 68 extends by 360° on the periphery of the casing part 8 and, in the axial direction, represents the connecting piece between the two annular casing parts 69 and 70. The annular casing part 69 constitutes the upstream closing seal of the U-shaped receiving and thrust ring 66, and the annular casing part 70 the downstream closing end.

The receiving and thrust ring 66 is dimensioned to receive a sealing ring 72. The annular casing parts 69 and 70, which point radially to the outside, thereby form the lateral surfaces and the angular base 68 the groove bottom of the annular groove that is needed to receive the sealing ring 72. The sealing ring 72 provides sealing action between the periphery of the fuel-injection valve 5 with the gas-containing sleeve 1 and the valve mounting (not shown), for example, the intake line of the internal combustion engine, or rather the fuel- and or gas-distributor line.

FIG. 2 depicts a first variant of the receiving and thrust ring 66. In this first variant, the gas-containing sleeve 1 and the receiving and thrust ring 66 are manufactured independently of one another. Both the gas-containing sleeve 1 as well as the receiving and thrust ring 66 are manufactured, for example, as sheet steel stampings. A fixed and permanent connection of the two parts is achieved by the receiving and thrust ring 66, together with its annular base 68, being secured to the periphery of the casing part 8 of the gas-containing sleeve 1, while adjoining it by means, for example, of a circumferential third seam 74 using welding or hard-soldering means.

A second variant of the design of the receiving and thrust ring 66 is clarified by FIG. 3. In this case, the gas-containing sleeve 1 is designed as a one-piece lathed part with the receiving and thrust ring 66. This eliminates the jointing operation previously required to connect the two parts and, as a result, sealing problems do not occur in this area. Admittedly, though, it is cost intensive to manufacture this one-piece lathed part. When selecting the variants, one should observe the various factors.

In both variants, the indentation 60 is formed in the base part 9 of the gas-containing sleeve 1. The indentation 60 runs concentrically, for example, in the outer radial area 59 of the base part 9 and extends upstream to a small axial degree so as to form a circumferential removal groove 61 on its downstream side. The purpose of the removal groove 61 is to collect precipitated fuel and to enable fuel to be selectively removed from the outer radial area 59. Particularly when the internal combustion engine is started up, there is the danger of more substantial wetting of the downstream surfaces of the base part 9 of the gas-containing sleeve 1. The removal groove 61 guarantees that larger fuel quantities will not be arbitrarily removed from the gas-containing sleeve 1, since fuel can already be removed from the outer radial area 59 when just small quantities have collected. Moreover, the removal groove 61 prevents fuel from traveling in the radial direction along the gas-containing sleeve 1 via the removal groove 61 to the outside.

Figure 4:
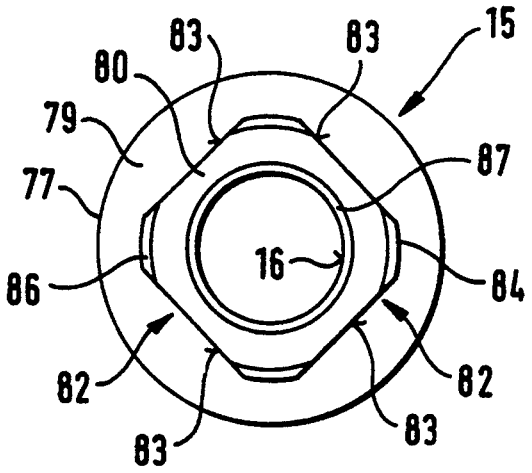
FIG. 4 is a top view in an upstream direction of a valve support in the form of a square.
Figure 5:
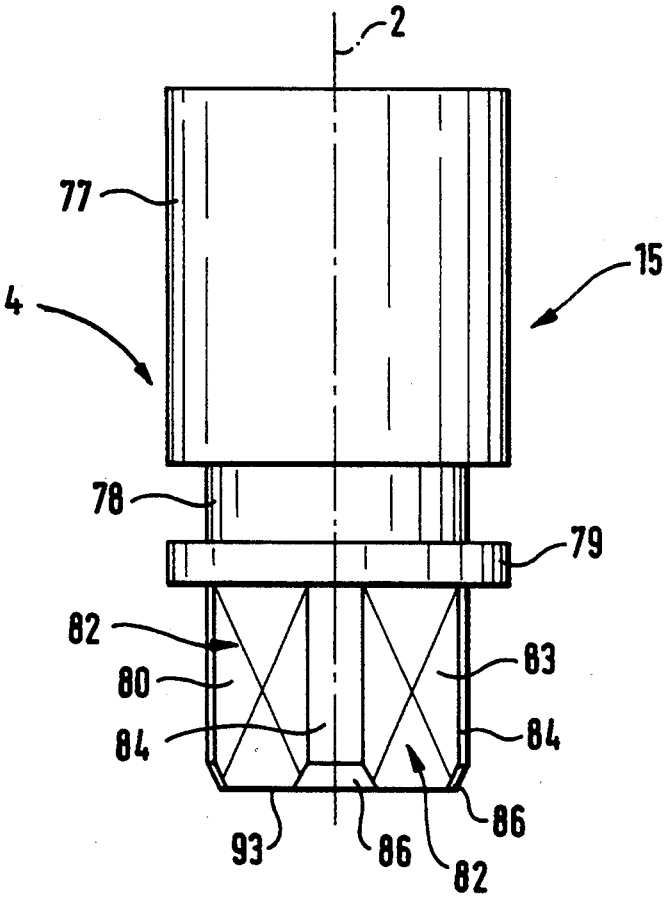
FIG. 5 is a side view of a valve support.

FIGS. 4 and 5 show the stepped, tubular valve support 15. The valve support 15 is partitioned, for example, into four axial sections, which are distinguished by their varying outside diameters, or rather outside contours. A first tubular, upstream section 77 is designed with an annular cross-section, since the longitudinal opening 16 runs inside of it, as in the other subsequent axial sections, concentrically to the longitudinal valve axis 2. This first section 77 of the valve support 15 has an axial extent which corresponds approximately to half the axial extent of the entire valve support 15, i.e., the section 77 constitutes the axially longest part of the valve support 15. Upstream, the first section 77 is directly adjoined by a second tubular section 78 having an annular cross-section, which is distinguished by a smaller outside diameter and a considerably smaller axial extent compared to the first section 77.

The second section 78 is followed downstream by a third tubular section 79 having only a small axial extent and, for example, the outside diameter of the first section 77. Because of the larger outside diameter of the sections 77 and 79 compared to the second section 78, a groove is created on the valve support 15. This groove facilitates a simple and secure installation in a valve mounting. A fourth section 80 constituting the downstream end of the valve support 15 likewise has a circular periphery, which is interrupted by at least one axially running depression 82 that has been formed, for example, by removing material. At the same time, the circular longitudinal opening 16 continues coaxially in the inside.

In the exemplary embodiment according to FIGS. 4 and 5, the outside contour of the fourth section 80 of the valve support 15 is designed so as to allow four flat rectangular surfaces 83 to be interconnected via rounded-off edges 84, which are offset from one another by 90° and form circular areas. In the case of a square-shaped fourth section 80 of the valve support 15, the four surfaces 83 delimit the depressions 82 to the inside and each extend, accordingly, at a right angle to the two adjacent, i.e., to the two surfaces 83, each of which directly adjoin the edges 84 of a surface 83. The outside contour of the fourth section 80 of the valve support 15, together with its four flat surfaces 83 and the rounded-off edges 84 joining these surfaces 83, are manufactured on computer-controlled lathes.

First chamfers 86 are formed at the downstream end of the fourth section 80 of the valve support 15 on the outside contour in the area of the four rounded-off edges 84. Their purpose is to simplify the sliding of the gas-containing sleeve 1 on to the valve support 15. The chamfers 86 are premolded so as to create a radial tapering in the downstream direction of the fourth section 80 of the valve support 15. The flat surfaces 83 do not have any chamfers, since during assembly or in the assembled state, the gas-containing sleeve 1 does not at all come into contact with the surfaces 83. Also, inside the valve support 15, a second chamfer 87 is configured at its downstream end. It represents a downstream widening of the diameter of the longitudinal opening 16.

Outside of their downstream chamfers 86, the four rounded-off edges 84 have radii as circular areas, which correspond to the radius of the casing part 8 of the gas-containing sleeve 1. This guarantees that even without the subsequent jointing operation, such as laser welding, an excellent seating of the gas-containing sleeve 1 on the valve support 15 is achieved.

Mounting the gas-containing sleeve 1 on the valve support 15 entails several steps. In a first process step, the gas-containing sleeve 1 is slid with its casing part 8 in the axial direction, viewed from the downstream end of the valve support 15, in the upstream direction on to the valve end 4, especially on to the fourth section 80 of the valve support 15. In this case, contacts are made between the circular areas, here the rounded-off edges 84 of the fourth section 80, which provide guidance for the sliding operation, and with the casing part 8 of the gas-containing sleeve 1, while gas interspaces 90 are created between the flat surfaces 83 of the fourth section 80 and the casing part 8. The gas required to prepare the fuel flows through these interspaces.

The gas-containing sleeve 1 is placed on in the upstream direction up to a predetermined axial position and then retained, for example, by a tool. In this briefly localized position of the gas-containing sleeve 1, a radially running annular gas gap 91 is formed between the top front side 57 of the inner radial area 55 of the gas-containing sleeve 1 and the downstream side 56 of the base 33 of the apertured spray disk 34. The axial extent of this annular gas gap 91 defines the gas quantity that is supplied to the fuel emerging from the ejection-spray openings 40 of the apertured spray disk 34. The purpose of the narrow annular gas gap 91 is to supply the gas flowing out of the gas interspaces 90 and to meter the gas. Because of the small axial extent of the narrow annular gas gap 91 in the direction of the longitudinal valve axis 2, the supplied gas is greatly accelerated, so that it atomizes the fuel to an especially fine spray.

Before the gas-containing sleeve 1 and the valve support 15 are permanently joined, the gas flow rate through the annular gas gap 91 is measured by means of a flow-rate meter and compared to required setpoint values. These values are specified to obtain the most homogenous possible fuel-gas mixture, so as to render possible an optimal combustion. If the actual value and the setpoint value do not conform, the gas-containing sleeve 1 is shifted axially until the desired gas-flow-rate values are achieved. After that, the final localization of the gas-containing sleeve 1 is undertaken in a last process step, in that the gas-containing sleeve 1 is secured to the circular areas, for example at the rounded-off edges 84 of the valve support 15, which it is directly contiguous to, in the axial direction outside of the receiving and thrust ring 66 with weld points 92, for example by means of a laser.

After the gas-containing sleeve 1 is mounted on the valve support 15, several consecutive spaces are produced to allow the gas to flow through from the upstream end 53 of the gas-containing sleeve 1 to the annular gas gap 91 between the downstream end 56 of the base 33 of the apertured spray disk 34 and the top front side 57 of the inner radial area 55 of the base part 9 of the gas-containing sleeve 1. In the assembled state, the inner cup of the base part 9 projects so far upstream into the fuel-injection valve 5, that precisely the desired axial extent of the annular gas gap 91 is achieved between the apertured spray disk 34 and the inner radial area 55 of the base part 9. Consequently, the inner radial area 55 of the base part 9 is situated further upstream than is a downstream closing end 93 of the valve support 15, while the outer radial area 59 is downstream from this closing end 93 of the valve support 15, and the axial area 58 extends both upstream as well as downstream from the closing end 93 of the valve support 15, as a connection between the inner radial area 55 and the outer radial area 59.

The gas thus flows past the collar 65 of the casing part 8 into at least one gas interspace 90 between the valve support 15 and the casing part 8 of the gas-containing sleeve 1, which is formed by the at least one depression 82 on the periphery of the valve support 15. Between the outer radial area 59 of the base part 9 of the gas-containing sleeve 1 and the downstream closing end 93 of the valve support 15, the gas enters into an annular flow channel 94, which is radially traversed by the gas flow. After that, the gas flows axially upstream in an annular channel 95 between the axial area 58 of the gas-containing sleeve 1 and the inner wall of the longitudinal opening 16 in the valve support 15 up to the annular gas gap 91, through which meal is the metering-in of the gas takes place to atomize the fuel.

FIGS. 6 through 9 illustrate further exemplary embodiments, which differ from one another by the shape of the valve end 4, in particular of the fourth section 80 of the valve support 15. Here, the parts that remain the same, or rather have the same function as those of FIGS. 1, 4 and 5, are characterized by the same reference numerals. In FIGS. 6 through 9, views of the exemplary embodiments are shown looking upstream at the valve support 15. These embodiments exhibit different-shaped depressions 82, which were achieved, for example, by removing material.

In the exemplary embodiment according to FIG. 6, the fourth section 80 of the valve support 15 is designed so that a flat, for example rectangular surface 83, delimits the depression 82 to the inside. Outside of the surface 83, the periphery of the valve support 15 is formed by the circular area 84, on whose downstream end, the chamfer 86 is premolded. The circular area 84 of the fourth section 80 of the valve support 15 has approximately the same radius as the radius of the casing part 8 of the gas-containing sleeve 1, to render possible a problem-free jointing of both component parts, for example by means of laser welding.

FIG. 7 depicts an exemplary embodiment in which two flat, for example, rectangular surfaces 83 delimit the depressions 82 in the fourth section 80 of the valve support 15 to the inside. These depressions were formed, for example, by removing material. The outside contour of the valve support 15 is designed to allow the two surfaces 83 to be interconnected by circular areas 84, so that the surfaces 83 and the circular areas 84 alternate with each other on the periphery of the fourth section 80 of the valve support 15.

FIG. 8 clarifies an exemplary embodiment in which the fourth section 80 of the valve support 15 has a triangular shape. In this case, the three surfaces 83 delimit the three depressions 82 to the inside in the direction of the longitudinal opening 16, while the circular areas 84 join precisely two adjacent surfaces 83 at the periphery. The circular areas 84 are offset from one another, for example, by 120°. In this exemplary embodiment as well, the surfaces 83 and circular areas 84 alternate with one another on the periphery of the fourth section 80 of the valve support 15. Likewise conceivable are arrangements having more than four depressions 82 each, which are delimited to the inside by surfaces 83, and circular areas 84, so that in the final analysis, the fourth section 80 of the valve support 15 has a polygon shape.

The depression 82 in the exemplary embodiment of FIG. 9 is formed by at least one groove 97, which is depicted only exemplarily. To form axially running gas interspaces 90 between the casing part 8 of the gas-containing sleeve 1 and the valve support 15 by means of depressions 82 at the periphery of the valve support 15, the most greatly differing specific embodiments of grooves 97 are conceivable, for example with rectangular, triangular, semi-circular or similar cross-sections. As in previous exemplary embodiments, the periphery of the valve support 15 extends outside of the groove 97 as a circular area 84, on whose downstream end, the chamfer 86 is premolded, for example. Moreover, when needed, it is possible to create combinations of groove-shaped and flat depressions 82 on a valve support 15.

What is claimed is:

1. A device for injecting a fuel gas mixture, comprising:

a) a fuel injection valve having a longitudinal valve axis and a valve end, said valve end having at least one ejection-spray opening and a circular perimeter, said circular perimeter including at least one depression and at least one circular area; and b) a cup-shaped gas-containing sleeve, gas being supplied between said valve end and said sleeve, said sleeve having a casing part and a base part, said casing part axially surrounding, at least in part, said valve end, said base part radially surrounding, at least in part, said valve end, said base part having at least one mixture-ejection-spray opening, and said casing part abutting on at least one circular area of said valve end and forming together with said depression at least one gas interspace extending in the axial direction.

2. The device as set forth in claim 1, wherein said fuel injection valve end further includes a tubular valve support, the bottom axial section of said valve support having the at least one depression delimited by a surface area.

3. The device as set forth in claim 2, wherein said valve end has a polygonal shape having a circular perimeter, said perimeter including alternating circular areas and surface areas, said surface areas delimiting said depressions.

4. The device as set forth in claim 1, wherein said valve end has at least one depression formed by at least one groove.

5. The device as set forth in claim 1, wherein said circular area of said valve end has the same radius as the radius of said casing part of said gas-containing sleeve.

6. The device as set forth in claim 1, wherein said casing part is permanently attached to said valve end at at least one circular area.

7. The device as set forth in claim 1, wherein said casing part is permanently attached to said valve end at at least one area via welding points.

8. The device as set forth in claim 1, wherein said base part of said gas-containing sleeve further includes an inner radial area, an outer radial area and an axial area, said inner radial area, said outer radial area and said axial area running substantially concentrically to said longitudinal valve axis.

9. The device as set forth in claim 8, wherein said inner radial area together with said mixture-ejection-spray opening form a cup bottom of an inner cup of said base part of said gas-containing sleeve, said inner cup running substantially in the axial direction in a direction opposite to an outer cup formed by said gas-containing sleeve.

10. The device as set forth in claim 8, wherein said axial area is inclined toward said longitudinal valve axis and running substantially downstream while widening in a truncated-cone shape.

11. The device as set forth in claim 1, wherein the upstream end of said casing part of said gas-containing sleeve includes a collar pointing in a radial direction.

12. The device as set forth in claim 6, further comprising a radially outwardly directed circumferential U-shaped receiving and thrust ring.

13. The device as set forth in claim 7, further comprising a radially outwardly directed circumferential U-shaped receiving and thrust ring, said receiving and thrust ring affixed to the periphery of said casing part of said gas-containing sleeve outside of said welding points.

14. The device as set forth in claim 12, wherein said gas-containing sleeve is attached to said receiving and thrust ring via a weld, and each represents one component part.

15. The device as set forth in claim 12, wherein said gas-containing sleeve and said receiving and thrust ring include a one-piece lathed part.

16. The device as set forth in claim 8, wherein a concentric, circumferential, upstream-projecting indentation is formed in said outer radial area of said base part of said gas-containing sleeve.

17. The device as set forth in claim 16, wherein said indentation forms a removal groove in the downstream direction.

18. The device as set forth in claim 12, wherein said receiving and thrust ring are affixed to the periphery of said casing part of said gas-containing sleeve.

* * * * *

UNITED STATES PATENT AND TRADEMARK OFFICE

CERTIFICATE OF CORRECTION

PATENT NO. : 5,395,050
DATED : March 7, 1995
INVENTOR(S) : Nowak et al.

It is certified that error appears in the above-indentified patent and that said Letters Patent is hereby corrected as shown below:

Column 8, line 48, "meal is" should be --means--.

Signed and Sealed this

Twentieth Day of June, 1995

Bruce Lehman

*Attest:*

BRUCE LEHMAN

*Attesting Officer*

*Commissioner of Patents and Trademarks*